United States Patent [19]

Bauer et al.

[11] 4,109,779

[45] Aug. 29, 1978

[54] MEDIA POSITIONING MEANS FOR A PRINTER

[75] Inventors: Karl A. Bauer; Peter F. Baur; Horst H. Biedermann; Andreas Madel; Friedrich Nitsch, all of Augsburg; Ernst Pechinger, Herbertshofen; Walter Koenig; Armin Ipfelkofer, both of Augsburg; Johann J. Rindsfuesser, Neusaess; Helmut Weber, Augsburg, all of Fed. Rep. of Germany

[73] Assignee: NCR Corporation, Dayton, Ohio

[21] Appl. No.: 714,069

[22] Filed: Aug. 13, 1976

[51] Int. Cl.[2] ..... B41J 11/50

[52] U.S. Cl. ..... 400/584; 271/204; 271/268; 271/277; 400/582; 400/608.4; 400/617; 400/583.2; 400/635; 400/606

[58] Field of Search ..... 271/204, 277, 227, 228, 271/265, 266, 268; 197/2, 126, 127 R, 133 R, 1 R, DIG. 9

[56] References Cited

U.S. PATENT DOCUMENTS

| | | | |
|---|---|---|---|
| 2,774,457 | 12/1956 | Salzberger | 197/127 R |
| 3,137,379 | 6/1964 | Oberholzer et al. | 197/DIG. 9 |
| 3,663,010 | 5/1972 | Fredrick et al. | 271/268 |
| 3,730,517 | 5/1973 | Norton | 271/204 |
| 3,797,929 | 3/1974 | Deacon et al. | 271/204 |
| 3,910,395 | 10/1975 | Colglazier et al. | 197/1 R |
| 3,912,068 | 10/1975 | Kwan et al. | 197/135 R |
| 3,933,234 | 1/1976 | Smith | 197/127 R |
| 3,966,037 | 6/1976 | Zambolin | 197/144 |

FOREIGN PATENT DOCUMENTS

| | | | |
|---|---|---|---|
| 848,918 | 9/1960 | United Kingdom | 197/133 P |

*Primary Examiner*—William Pieprz
*Attorney, Agent, or Firm*—J. T. Cavender; Albert L. Sessler, Jr.; Elmer Wargo

[57] ABSTRACT

A media positioning means for a printer having first and second transport mechanisms which are positioned in opposed relation with each other to form a common throat therebetween. Each of the first and second transport mechanisms includes first and second endless belts, a cross bar whose ends are secured to the belts, and grippers mounted on the cross bar to enable first and second record media inserted in the throat to be individually gripped thereby and positioned in side by side or overlapping relationship with regard to a print line in the printer.

17 Claims, 7 Drawing Figures

HOME POSITION
10
16
18
20
28
24
164
171
170
182
180
174
172
178
176
179
SLIDE MEANS
181

PAPER LOADING POSITION
PRINT TABLE
10
16
18
20
22
28
24
164
166
171
170
182
180
174
172
178
176
179

MEDIA POSITIONING MEANS FOR A PRINTER

BACKGROUND OF THE INVENTION

This invention relates to a media positioning means for a machine like a printer for independently feeding a plurality of record media to a print station in the printer; the record media may be positioned in side by side relationship or in overlapping relationship at the print station.

In order to make certain business machines, like accounting machines, more versatile, it is necessary that such machines be capable of printing on a variety of record media or forms. Some of the record media to be printed upon are continuous forms, and others are manually inserted forms like ledger cards, passbooks, and the like. In certain situations it may be desirable to print the same information simultaneously or in one operation on two or more record media which are inserted in the machine.

Some prior art media positioning means are shown in the following U.S. Patent Nos.

3,426,345; — 3,653,483; and 3,553,649; — 3,684,076.

A German laid-open Application No. 2,118,414 discloses a record feeding mechanism in which a record material is held by electromagnetically operated clamps which are fixed to a bar whose ends are carried by a pair of endless belts; however, this prior art mechanism does not appear to be capable of independently feeding a plurality of record media to a print station so as to enable such media to be independently positioned in side by side relationship or in overlapping relationship at a print station as is done with the media positioning means of the present invention.

The media positioning means of the present invention is also simple to manufacture, is economical to produce, and can be readily incorporated in a variety of machines like printers, accounting machines, or other business machines.

SUMMARY OF THE INVENTION

This invention relates to a media positioning means having first and second transport means which are positioned in opposed relationship to each other so as to form a common throat therebetween thereby enabling at least first and second record media inserted in the throat to be independently moved and positioned with reference to a reference line like a print line in a printer.

DETAILED DESCRIPTION OF THE INVENTION

Figure 1:
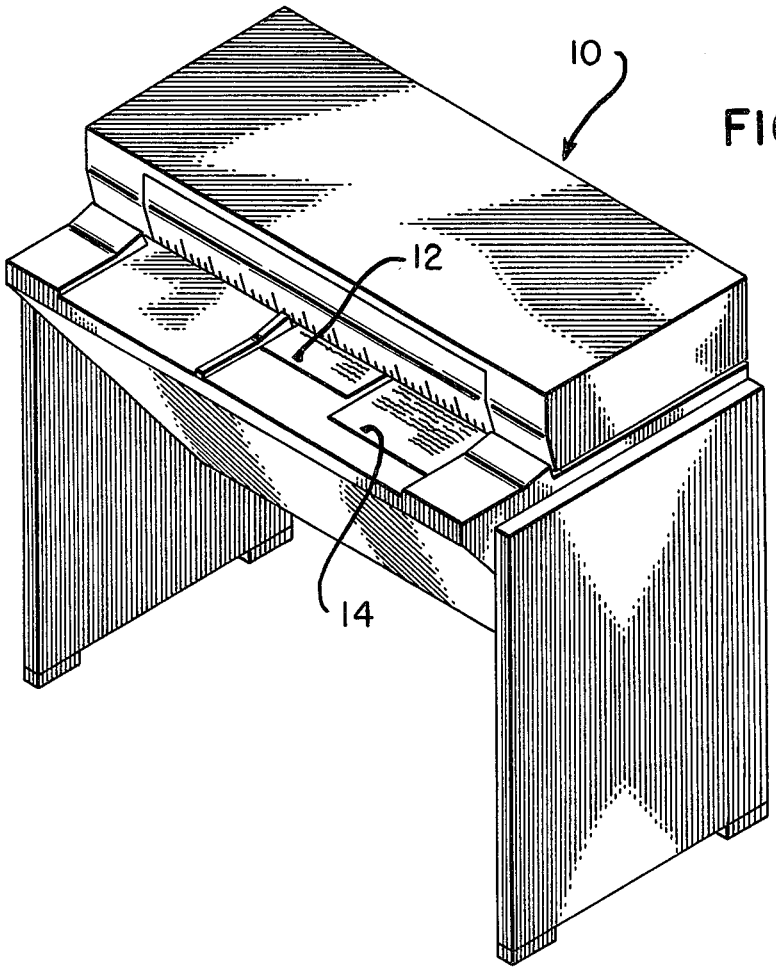
FIG. 1 is a general perspective view of a machine like an accounting machine in which the media positioning means of this invention may be incorporated, showing first and second media positioned therein in side by side relationship.

FIG. 1 is a general perspective view of a machine 10, like an accounting machine or other business machine, in which the media positioning means of this invention may be incorporated. A first record medium 12 and a second record medium 14 are shown positioned in side by side relationship in the machine 10.

Figure 2:
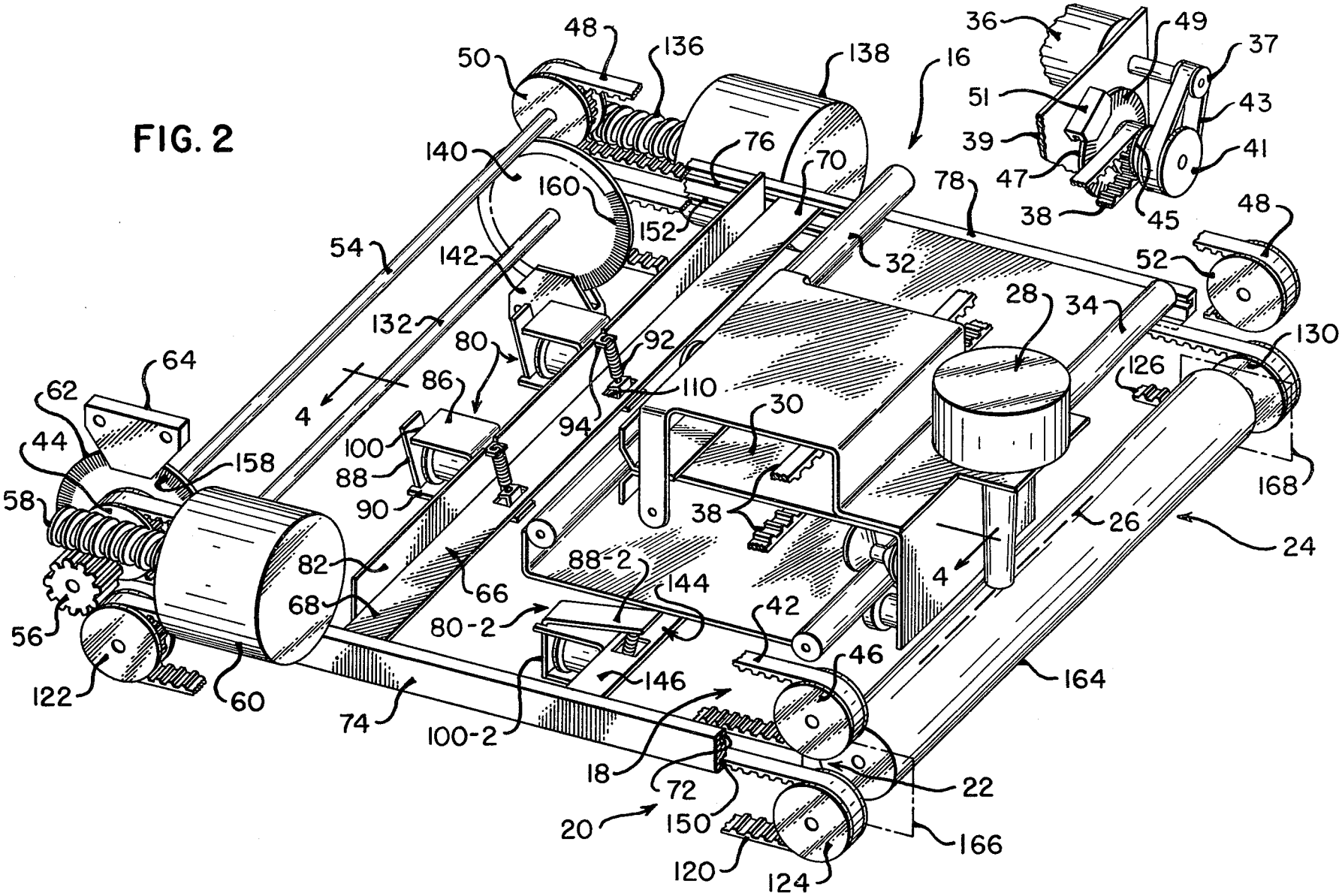
FIG. 2 is a general perspective view of the media positioning means of this invention, showing first and second transport means which are positioned in opposed relationship to form a common throat therebetween, a platen means, and a print head means in printing relationship with the platen means.
Figure 3:
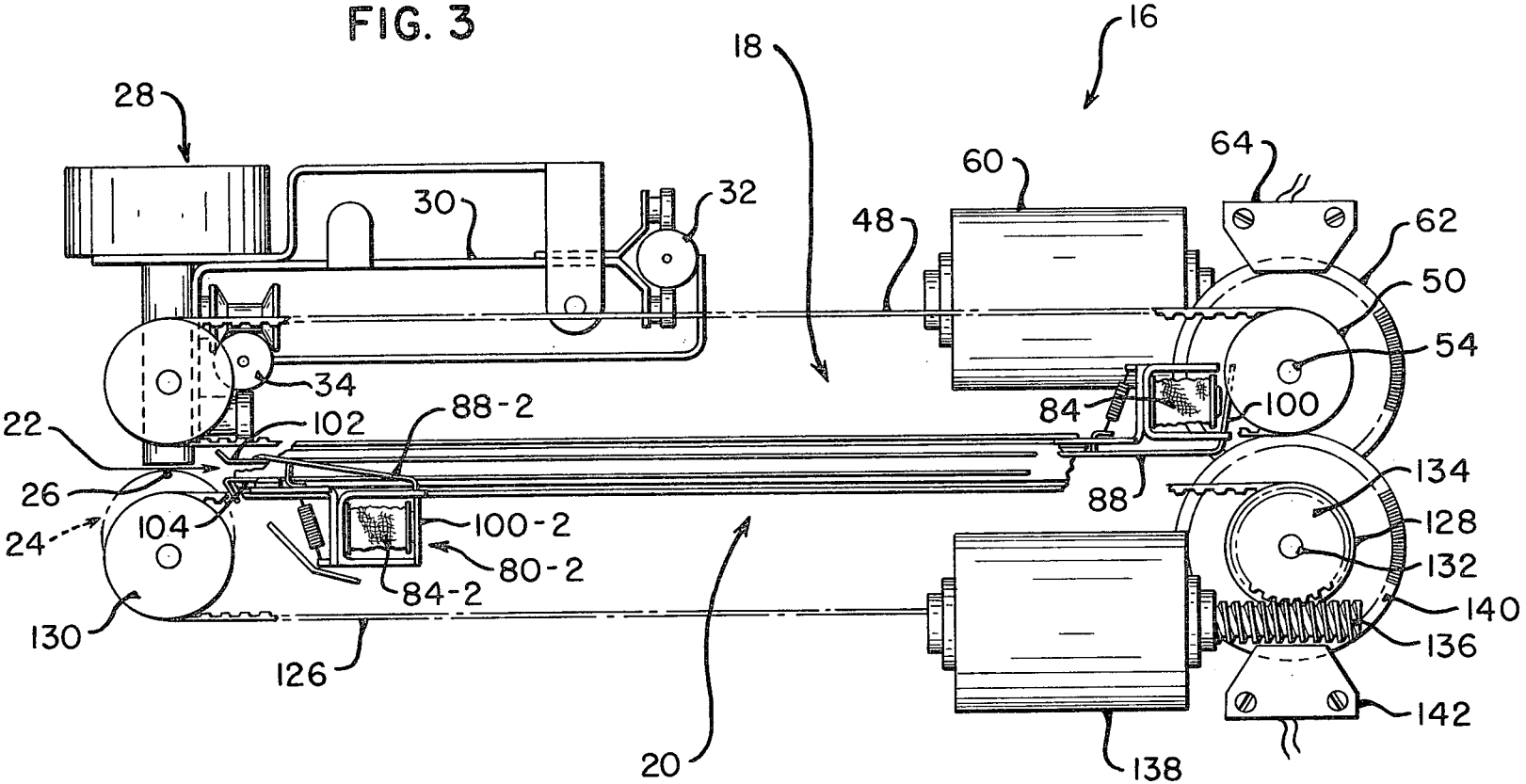
FIG. 3 is a side view, in elevation, showing additional details of the first and second transport means which each include first and second endless belt means, a bar means connected to the first and second belt means, gripping means mounted on the bar means, and drive means for moving the first and second endless belt means.

FIG. 2 is a general perspective view of the media positioning means of this invention which is designated generally as 16 and which includes first and second transport means designated generally as 18 and 20 respectively, as are best shown in FIG. 3. The first and second transport means 18, 20 are positioned in opposed relationship to each other to form a common throat 22 therebetween. The machine 10 also includes a platen means 24 having a reference line 26 or print line associated therewith, and a print head means 28 in printing relationship with the platen means 24. The means for moving the print head means 28 along the print line 26 may be conventional and may include a supporting carriage 30 moveably mounted on spaced, parallel supporting rods 32 and 34 (parallel to reference line 26) and moved by a reversible motor 36 and endless belt 38. The motor 36 is mounted on a plate 39, and its output pulley 37 is drivingly connected to a pulley 41 by a belt 43. A pulley 45 and timing disc 47 are fixed to pulley 41 to rotate therewith, and these three elements are conventionally supported for rotation on an axle (not shown) which is mounted in the plate 39. The timing disc 47 has optical markings 49 thereon which are detected by a conventional detector 51 for use in conventionally controlling the movement of the print head means 28 along the reference line 26. The endless belt 38 is supported near bar 74 by a pulley (not shown) and the belt 38 is secured to the carriage 30 to enable the carriage and print head means 28 to be conventionally traversed along the reference line 26.

The first transport means 18 includes first and second belt member or means like a first endless belt 42 which is mounted on spaced pulleys 44 and 46, and a second endless belt 48 which is mounted on spaced pulleys 50 and 52, as is best shown in FIG. 2. The pulleys 44 and 50 are fixed to rotate with a driving shaft 54 which is conventionally, rotatably supported in suitable supports not shown. One end of the shaft 54 has fixed thereto a gear 56 whose teeth are in driving engagement with a worm gear 58 which is reversibly driven by a reversible motor 60. The shaft 54 also has fixed thereto a conventional timing disc 62 which cooperates with a first conventional disc detector 64 as will be described later herein.

The first transport means 18 also includes a first bar member or means 66 (FIG. 2) having a first end 68 which is conventionally secured to the first endless belt 42 and a second end 70 which is similarly secured to the second endless belt 48. The first end 68 of the bar means 66 is slidably mounted in an upper slot 72 in a stationary bar 74 and the second end 70 of the bar means 66 is slidably mounted in an upper slot 76 in a stationary bar 78 to enable the bar means 66 to be moved in a direction which is perpendicular to the reference line 26 and in a plane which is perpendicular to the printing axis of the print head means 28. The bar means 66 is moved towards the reference line 26 by the belts 42 and 48 when the motor 60 is driven in one direction and is moved away therefrom when the motor 60 is driven in the opposite direction.

Figure 4:
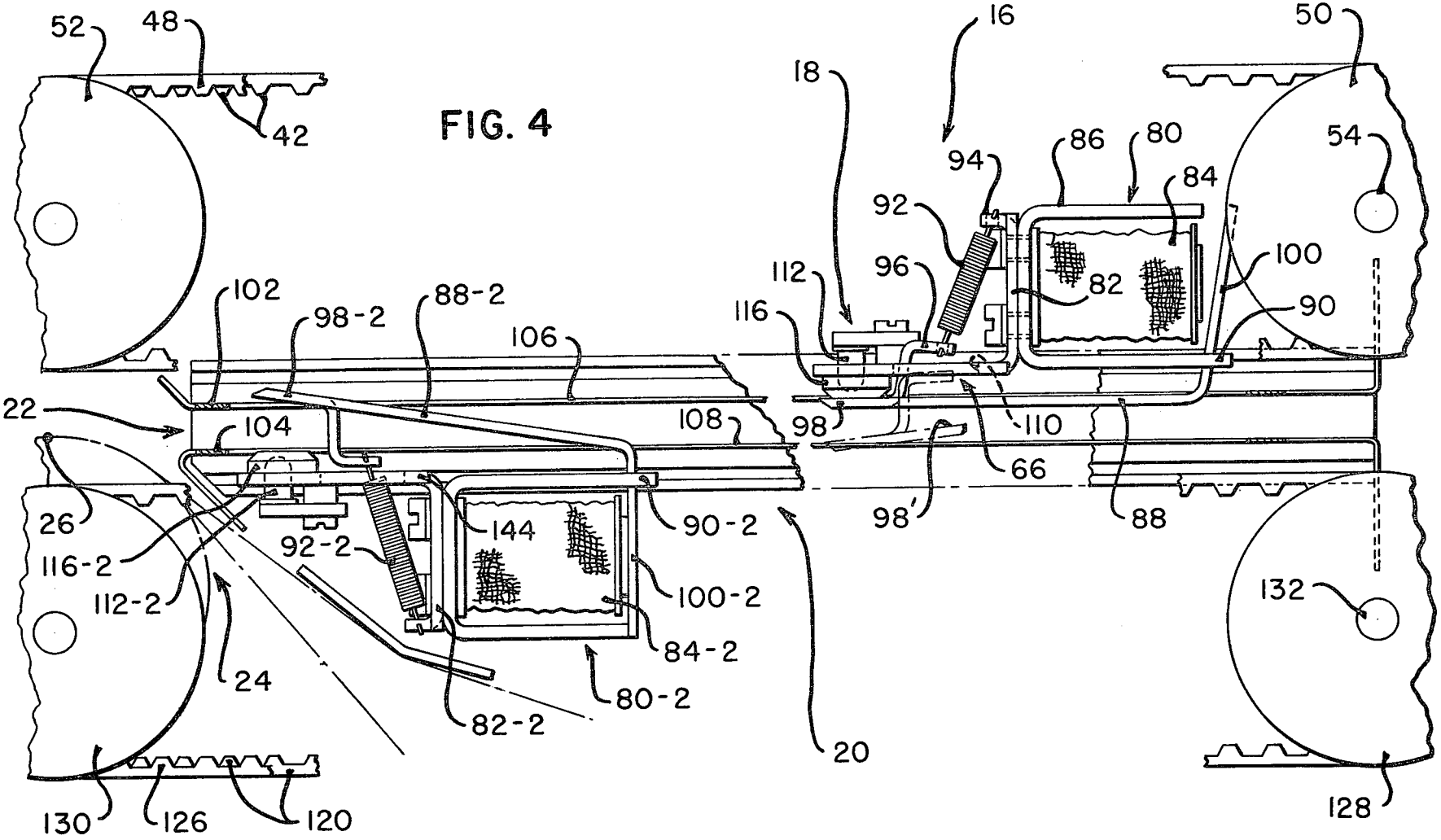
FIG. 4 is an enlarged, modified cross-sectional view, of a portion of FIG. 2, taken along the line 4—4 thereof, to show additional details of the gripping means and detector means associated therewith.

The first bar means 66 also has a plurality of attachment or gripper means 80 thereon for gripping a document or record medium and moving it relative to the reference line 26. The bar means 66 includes a support bar 82 which is positioned perpendicularly to the bar means 66, as is best shown in FIGS. 2 and 4. Each gripper means 80 includes a solenoid 84 and a "U"-shaped core piece 86 which is secured to the support bar 82. The solenoid 84 has an "L"-shaped armature or clapper 88 which is conventionally, pivotally mounted on a leg 90 of the core piece 86, as for example, by notching out a portion of the leg 90 and having shoulders on the clapper 88 abut against the leg 90, as is best shown in FIG. 4. The clapper 88 is retained on the solenoid 84 by utilizing a tension spring 92 having one end secured to an extension 94 of the support bar 82 and the remaining end secured to a generally "L"-shaped extension 96 which is formed from a portion of the armature or clapper 88. The spring 92 normally keeps the clapper 88 in the position shown in FIG. 4 in which the forward end 98 of the clapper is pulled out of the common throat 22. When the solenoid 84 is energized, the clapper 88 is pivoted on the leg 90, and the end 100 of the clapper 88 is attracted to the solenoid 84, causing the forward end 98 to enter the common throat 22, as shown in dashed outline 98', to receive a record medium inserted therein. The common throat 22 has an upper stationary plate 102 forming the upper boundary thereof and also has a lower stationary plate 104 forming the lower boundary thereof. The upper and lower plates 102, 104 have aligned slots therein as at 106, 108 respectively, which slots are formed perpendicularly to the reference line 26 to enable the gripper means 80 to be moved towards and away from the reference line 26 and to facilitate the gripping of a record medium inserted in the common throat 22 by having the end 98 of the clapper drop below the lower plate 104 through the slot 108 as shown at 98' in FIG. 4. The bar means 66 also has a hole 110 therein (FIGS. 2 and 4) for each gripper means 80 to enable the associated extension 96 and spring 92 to pass therethrough.

The first transport means 18 also has first detector means like 112 (shown in FIG. 4) associated therewith for detecting the edge of a record medium when it is inserted in the common throat 22 between the upper and lower plates 102, 104. The detector means 112 may be any conventional light source and light responsive member which coact to detect the presence of the edge of the record medium thereat, and several of such detector means 112 are positioned along the length of the bar means 66 with their associated gripper means 80. While only two gripper means 80 are shown along the length of bar means 66 to simplify the drawings, there are several such gripper means positioned along the length of bar means to enable a record medium to be positioned anywhere along the width of the common throat 22, and gripped by the gripper means 80.

In order to grip a document or record medium inserted in the throat 22, the solenoids 84 of all the gripper means 80 are energized by a control means (FIG. 7) to be later described herein, and the associated clappers 88 pivot on their respective legs 90 (FIG. 4) and the forward ends 98 of the clappers 88 pass through the associated slots (like 108) in the lower plate 104 to assume the position shown as at 98' in FIG. 4. In general, the gripper means 80 of the first transport means 18 have a home position in which they are positioned in the rearmost position shown in FIG. 4. As the record medium is inserted into the throat 22, the innermost edge thereof comes into operative proximity with the first detector means 112 which produce a signal which is fed to a line finding control means 114 (FIG. 7) to deenergize the solenoids 84, permitting the record medium to be gripped between the ends 98 of the clappers 88 and associated abutment members 116 (secured to the underside of the bar means 66) of the gripper means 80. The gripped record medium is then positioned with reference to the reference line 26 by the line finding control means 114 by energizing a first drive means 118 (including the reversible motor 60) to thereby position a particular line on the record medium (like 12 in FIG. 1) at the reference line 26 in preparation for printing by the print head means 28.

The second transport means 20 is generally similar to the first transport means 18 already described, and includes first and second belt member or means like a first endless belt 120 (FIG. 2) which is mounted on spaced pulleys 122 and 124, and a second endless belt 126 which is mounted on spaced pulleys 128 (not shown in FIG. 2) and 130. The pulleys 128 and 130 are fixed to rotate with a driving shaft 132 which is conventionally, rotatably supported in suitable supports (not shown). One end of the shaft 132 has fixed thereto a gear 134 (FIG. 3) whose teeth are in driving engagement with a worm gear 136 which is reversibly driven by a reversible motor 138. The shaft 132 also has fixed thereto a conventional timing disc 140 which cooperates with a second conventional disc detector 142 as will be described later herein.

The second transport means 20 also includes a second bar member or means 144 (FIG. 2) having a first end 146 which is conventionally secured to the first endless belt 120 and a second end 148 (not shown) which is similarly secured to the second endless belt 126. The first end 146 of the bar means 144 is slidably mounted in a lower slot 150 (FIG. 2) of the stationary bar 74, and the second end 148 of the bar means 144 is slidably mounted in a lower slot 152 of the stationary bar 78 to enable the bar means 144 to be moved in a direction which is perpendicular to the reference line 26 and in a plane which is perpendicular to the printing axis of the print head means 28. The bar means 144 is moved towards the reference line 26 by the belts 120 and 126 when the motor 138 is driven in one direction and is moved away therefrom when the motor 138 is driven in the opposite direction.

The second bar means 144 also has a plurality of attachment or gripper means 80-2 thereon as is best shown in FIG. 4 for gripping a document or record medium and moving it relative to the reference line 26. The bar means 144 includes a support bar 82-2 which is positioned perpendicularly to the bar means 144 as is best shown in FIGS. 2 and 4. The second gripper means 80-2 are identical to the first gripper means 80 and are spaced along the support bar 82-2 and are offset in a vertical plane with reference to the first gripper means 80 so as to enable the clappers 88-2 of the second gripper means 80-2 to enter the throat 22 without interfering with the clappers 88 of the first gripper means 80. Because the gripper means 80-2 are identical to the gripper means 80, the gripper means 80-2 are not described in further detail except to say that the individual elements thereof are given the same reference numerals as the elements of gripper means 80 except the elements in gripper means 80-2 are given the added reference numeral 2, as for example, clapper 88-2 of gripper means 80-2 is identical to the clapper 88 of gripper means 80.

The second gripper means 80-2 operate in the same manner as the first gripper means 80, except the gripper means 80-2 have a home position which is close to reference line 26 while the gripper means 80 have a home position which is more distant from the reference line 26 as is best shown in FIG. 4, and the gripper means 80-2 are inverted with respect to the gripper means 80.

The second transport means 20 also has a second detector means like 112-2 (FIG. 4) associated therewith for detecting when the edge of a record medium is inserted in the common throat between the upper and lower plates 102, 104 and approaches the end 98-2 of the clapper 88-2. The second detector means 112-2 is identical to detector means 112 already described.

Figure 7:
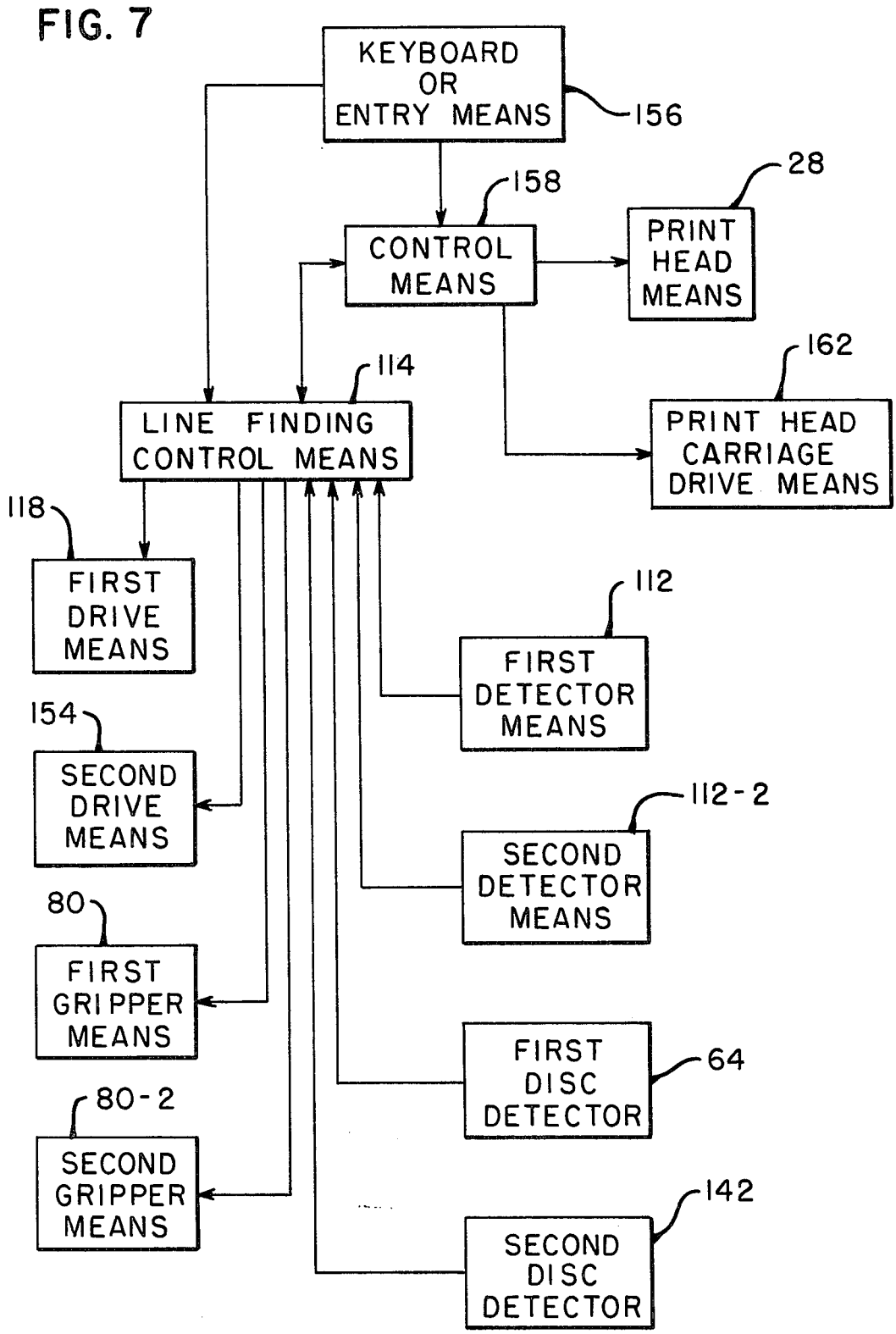
FIG. 7 is a general schematic diagram, in block form, of a circuit means which may be used with the media positioning means of this invention.

If a document is to be gripped by the second transport means 20, the solenoids 84-2 of the second gripper means 80-2 are energized by the control means shown in FIG. 7, and the clappers 88-2 pivot on their respective legs 90-2 (FIG. 4), and the forward ends 98-2 of the clappers 88-2 pass through associated slots in the upper plate 102 in a manner similar to that as was described in relation to the first gripper means 80. As the record medium is inserted in the throat 22, the innermost edge thereof comes into operative proximity with the second detector means 112-2 which produce a signal which is fed to the line finding control means 114 (FIG. 7) to deenergize the solenoids 84-2, permitting the record medium to be gripped between the ends 98-2 of the clappers 88-2 and the associated abutment members 116-2 (secured to the top side of bar means 144) of the gripper means 80-2. The gripped record medium is then positioned with reference to reference line 26 by the line finding control means 114 by energizing the second drive means 154 (including the reversible motor 138) to thereby position a particular line on the record medium (like 14 in FIG. 1) at reference line 26 in preparation for printing by the print head means 28.

The operation of the media positioning means 16 is as follows. If a first record medium 12 is to be gripped by the first transport means 18 and printed upon, and a second record medium 14 is to be gripped by the second transport means 20 and printed upon, the appropriate data can be entered on a keyboard or entry means 156 which is interconnected with a conventional control means 158 and the line finding control means 114 as shown in FIG. 7. The first record medium 12 will be gripped by the first gripper means 80 as previously described and the second record medium 14 will be gripped similarly by the second gripper means 80-2. The first disc 62 (FIG. 2) has a plurality of optical markings 158 thereon which cooperate with the first detector 64 to enable the first drive means 118 (including the motor 60) under the control of the line finding control means 114 to accurately position a line on the record medium with respect to the reference line 26.

Similarly, the second disc 140 (FIG. 2) has a plurality of optical markings 160 thereon which cooperate with the second disc detector 142 to enable the second drive means 154 (including the motor 138) under the control of the line finding control means 114 to accurately position a line on the record medium 14 with respect to the reference line 26. Because the control means 158, and the line finding control means 114 (FIG. 7) may be conventional, they are not described in further detail. While worm gears 58 and 136 (FIG. 2) are used in the first and second drive means 118 and 154 respectively, it is understood that other connecting techniques may be used, as for example, the belt 43, pulleys 37, 41, 45 and timing disc 47 associated with motor 36 in FIG. 2 may also be used.

While the record media 12, 14 are shown in side by side relation in FIG. 1, a feature of this invention is that the media 12, 14 can be placed in overlapping relationship to enable the print head means 28 to print simultaneously on both media on specific lines thereon after having been set by the line finding control means 114. Because the first gripper means 80 are located along the entire length of the bar means 66 and the second gripper means 88-2 are located along the entire length of the bar means 144, the record media 12, 14 may be positioned in any location along the width of the common throat 22. After printing by the print head means 28 under the control of a conventional print head carriage drive means 162 (including the reversible motor 36), the record media 12, 14 are moved out of the throat 22 towards the reference line 26, whereupon the solenoids 84, 84-2 are energized to release the record media 12, 14, enabling them to be removed from the machine 10.

Figures 5, 6:
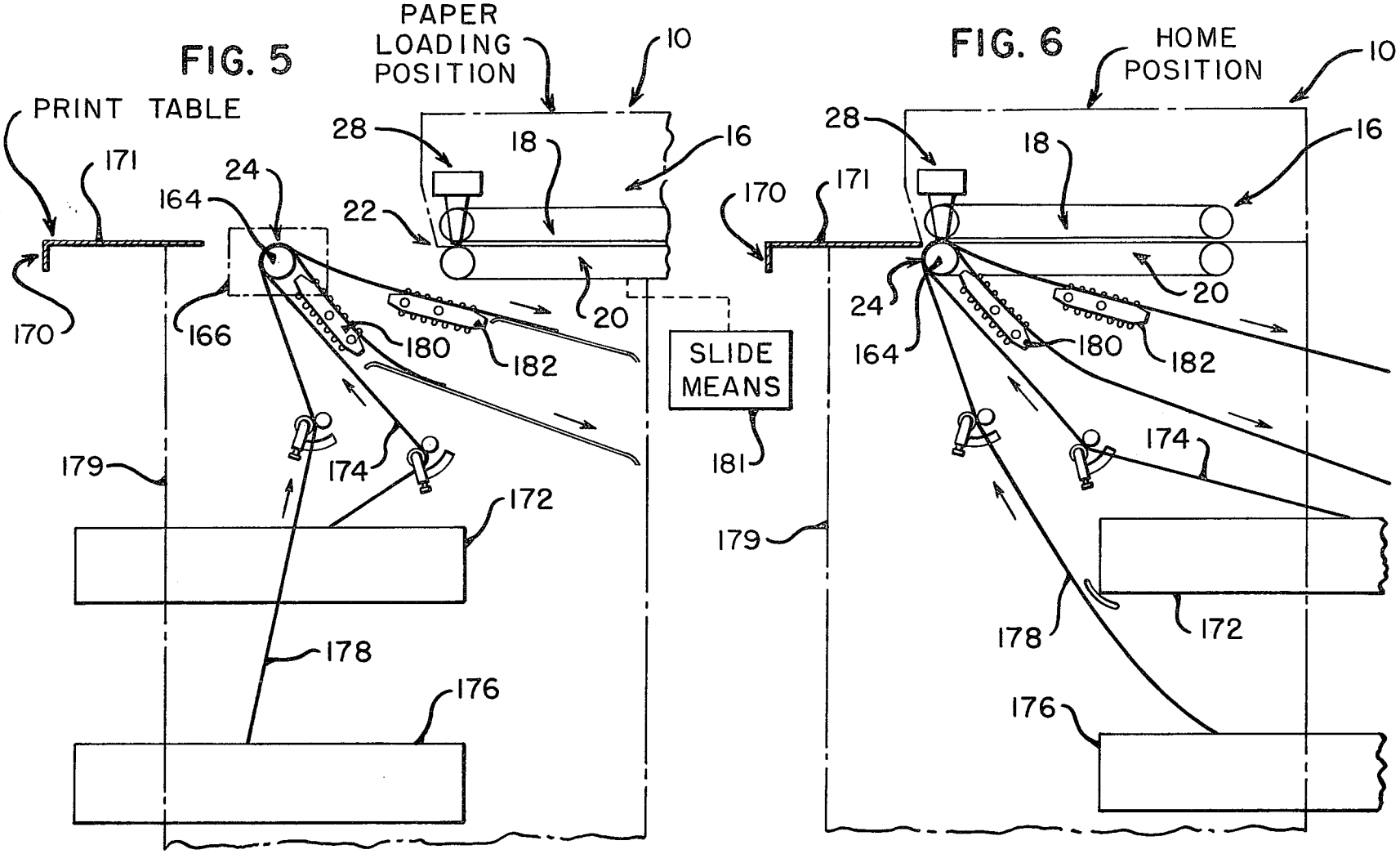
FIG. 5 is a side view of the accounting machine shown in FIG. 1 to show how the print head means and a supporting unit or table thereof can be moved to a loading position to accommodate a continuous type form in addition to record media like ledger cards which may be manually inserted in the machine.
FIG. 6 is a view similar to FIG. 5 showing the print head means and supporting table returned to a home position in which the print head means is in printing relationship with the platen means.

In addition to receiving record media 12, 14 in the form of ledger cards, for example, the machine 10 is also capable of receiving and printing upon continuous forms as shown in FIGS. 5 and 6. In order to effect this, the platen means 24 includes a stationary platen 164 which is conventionally mounted in side frames 166 and 168 (FIG. 2) which are part of a supporting unit 170 including a printer table 171 (FIG. 5) which is conventionally, slidably mounted in the frame means of the machine 10 to enable the supporting unit 170 to be pulled out between the extended position shown in FIG. 5 and the operating position shown in FIG. 6. The media positioning means 16 is also conventionally slidably mounted in the frame means 179 (by a conventional sliding means 181) of the machine 10 to enable it to be moved back from the platen means 24 (as shown in FIG. 5) and returned to the home position shown in FIG. 6 in which the print head means 28 is positioned in operative relationship with the platen means 24. The supporting unit 170 also includes a first supply 172 of continuous forms 174 and may include a second supply 176 of continuous forms 178 which are routed around the platen means 24 as shown in FIGS. 5 and 6. Any conventional feed means such as pin feed means 180 and 182 under the control of the control means 158 (FIG. 7) may be used to feed the forms 174 and 178 respectively to the platen means 24. If found necessary or desirable, a suitable conventional platen indexing means (not shown but under the control of the control means 158)

could be used to index the platen means 24. By this construction, the machine 10 could be utilized to print on continuous forms 174, 178 or ledger type record media 12, 14.

What is claimed is:

1. A media positioning means comprising:

first and second transport means positioned in opposed relation to each other and forming a common throat therebetween and having a reference line associated therewith for independently moving first and second media respectively, in said common throat towards and away from said reference line, said common throat having an open end to enable said first and second media to be inserted therein, and said reference line being located adjacent to said open end.

2. The media positioning means as claimed in claim 1 in which said first and second transport means have first and second attachment means respectively associated therewith for respectively attaching said first and second media thereto and moving in said common throat.

3. The media positioning means as claimed in claim 2 in which said first and second transport means are spaced in relation to each other to enable said first and second media to lie in at least partially overlapping relationship while positioned with reference to said reference line.

4. The media positioning means as claimed in claim 3 in which said first and second transport means have a length which is sufficient as measured along the direction of said reference line to enable said first and second media to be positioned in side by side relationship when positioned with reference to said reference line.

5. The media positioning means as claimed in claim 2 in which said first and second attachment means are located on their associated first and second transport means so as to enable the first and second media to be moved in said common throat.

6. The media positioning means as claimed in claim 2 in which said first and second attachment means each have a plurality of gripper means for gripping said first and second media.

7. The media positioning means as claimed in claim 6 in which said gripper means of each of said first and second attachment means are aligned along a line which is parallel to said reference line, and said first and second transport means are positioned to move said first and second media in a direction which is perpendicular to said reference line.

8. The media positioning means as claimed in claim 2 in which said first and second transport means also respectively comprise:

first and second belt members to which said first and second attachment means are respectively, operatively connected, and first and second drive means for respectively driving said first and second belt members to move said first and second media in a direction which is perpendicular to said reference line.

9. A media positioning means comprising:

first and second transport means positioned in opposed relation to each other and forming a common throat therebetween and having a reference line associated therewith for independently moving first and second media respectively, in said common throat towards and away from said reference line, said common throat having an open end to enable said first and second media to be inserted therein, and said reference line being located adjacent to said open end, said first and second transport means respectively comprising:

first and second belt members;

first and second bar members aligned parallel to said reference line and secured to said first and second belt members, respectively to be moved towards and away from said reference line; and first and second gripper means attached to said first and second bar members respectively, for moving into said common throat to grip said first and second media therein, respectively and to enable said first and second media to be positioned anywhere in said common throat.

10. The media positioning means as claimed in claim 9 in which said first and second transport means further comprise, respectively, first and second automatic line finding means operatively connected to said first and second belt members respectively to position a line on said first and second media with reference to said reference line.

11. The media positioning means as claimed in claim 10 in which said first and second belt members each comprise spaced first and second endless belts, with said first bar member being connected to the first and second endless belts of said first belt member and said second bar member being connected to the first and second endless belts of said second belt member.

12. The media positioning means as claimed in claim 11 in which said first and second gripper means each comprise at least first and second spaced apart clamps;

each said first and second clamp comprising:

a frame;

a clamping lever pivotally mounted on said frame;

means for biasing said clamping lever to a closed position to grip a record medium therein; and actuating means for moving said clamping lever against the bias of said biasing means to an open position to enable an edge of a record medium to be inserted in clamping relationship therewith.

13. The media positioning means as claimed in claim 12 in which said first and second clamps of said first and second gripper means are secured to said first and second bar members, respectively, so as to enable the clamping levers of said first and second clamps of said first and second gripper means to extend into said common throat when moved to said open position.

14. A printer comprising:

a platen, a print head, and means for moving said print head in printing relationship with said platen; and first and second transport means positioned in opposed relationship with each other and forming a common throat therebetween and having a reference line on said platen associated therewith, for independently moving at least first and second media respectively in said common throat towards and away from said reference line to enable said print head to print on selected lines on said first and second media; said common throat having an open end therein to enable said first and second media to be inserted therein; and said platen being located adjacent to said open end.

15. The printer as claimed in claim 14 in which said first and second transport means respectively have first and second attachment means associated therewith for gripping and moving said first and second media respectively in a direction which is perpendicular to said reference line.

16. The printer as claimed in claim 15 in which said first and second transport means respectively comprise:

first and second belt members;

first and second bar members aligned parallel to said reference line and secured to said first and second belt members, respectively, to be moved towards and away from said reference line; and first and second gripper means attached to said first and second bar members respectively to grip said first and second media, respectively;

said first and second gripper means each comprising at least first and second spaced apart clamps;

each said first and second clamp comprising:

a frame;

a clamping lever pivotally mounted on said frame;

means for biasing said clamping lever to a closed position to grip a record medium therein; and actuating means for moving said clamping lever against the bias of said biasing means to an open position to enable an edge of a record medium to be inserted in clamping relationship therewith;

said first and second clamps of said first and second gripper means being secured to said first and second bar member, respectively, so as to enable the clamping levers of said first and second clamps of said first and second gripper means to extend into said common throat when moved to said open position.

17. The printer as claimed in claim 16 in which said first and second transport means further comprise, respectively, first and second automatic line finding means operatively connected to said first and second belt members respectively to position a line on said first and second media with reference to said reference line.

* * * * *

UNITED STATES PATENT OFFICE

CERTIFICATE OF CORRECTION

Patent No. 4,109,779 Dated August 29, 1978

Inventor(s) Karl A. Bauer et al.

It is certified that error appears in the above-identified patent and that said Letters Patent are hereby corrected as shown below:

Column 7, cancel lines 34 through 38 inclusive.

On the title page, after the abstract "17 Claims" should read -- 16 Claims --.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*